US008272576B2

(12) United States Patent
Doak et al.

(10) Patent No.: US 8,272,576 B2
(45) Date of Patent: Sep. 25, 2012

(54) GAS DYNAMIC VIRTUAL NOZZLE FOR GENERATION OF MICROSCOPIC DROPLET STREAMS

(75) Inventors: Robert Bruce Doak, Tempe, AZ (US); John C. H. Spence, Tempe, AZ (US); Uwe Weierstall, Phoenix, AZ (US); Daniel DePonte, Tempe, AZ (US); Dmitri Starodub, Sunnyvale, CA (US); Jared Scott Warner, Tempe, AZ (US)

(73) Assignee: Arizona Board of Regents, a body corporate acting for and on behalf of Arizona State University, Scottsdale, AZ (US)

( * ) Notice: Subject to any disclaimer, the term of this patent is extended or adjusted under 35 U.S.C. 154(b) by 119 days.

(21) Appl. No.: 12/664,437

(22) PCT Filed: Jun. 20, 2008

(86) PCT No.: PCT/US2008/067693

§ 371 (c)(1),
(2), (4) Date: Apr. 30, 2010

(87) PCT Pub. No.: WO2009/091416

PCT Pub. Date: Jul. 23, 2009

(65) Prior Publication Data

US 2010/0243753 A1 Sep. 30, 2010

Related U.S. Application Data

(60) Provisional application No. 60/945,809, filed on Jun. 22, 2007.

(51) Int. Cl.
*A62C 5/02* (2006.01)

(52) U.S. Cl. ..... 239/8; 239/128; 239/135; 239/424; 239/433; 239/589; 250/288

(58) Field of Classification Search ..... 239/8, 11, 239/418, 423, 424, 433, 589, 128, 135; 250/288
See application file for complete search history.

(56) References Cited

U.S. PATENT DOCUMENTS

| | | | | |
|---|---|---|---|---|
| 4,358,302 | A * | 11/1982 | Dahneke | 239/424 |
| 5,848,751 | A | 12/1998 | Wang et al. | |
| 6,386,463 | B1 * | 5/2002 | Ganan-Calvo | 239/8 |
| 6,478,240 | B1 * | 11/2002 | Dorkin et al. | 239/433 |
| 6,554,202 | B2 * | 4/2003 | Ganan-Calvo | 239/424 |
| 2001/0010206 | A1 | 8/2001 | Bryning et al. | |

* cited by examiner

*Primary Examiner* — Steven J Ganey
(74) *Attorney, Agent, or Firm* — McDonnell Boehnen Hulbert & Berghoff LLP

(57) ABSTRACT

A nozzle for producing a single-file stream of droplets of a fluid, methods using the nozzle, and an injector, comprising the nozzle of the invention, for providing the single-file stream of droplets of a fluid to a high-vacuum system are described. The nozzle comprises two concentric tubes wherein the outer tube comprises a smoothly converging-diverging exit channel and the outlet end of the first tube is positioned within the converging section of the exit channel.

38 Claims, 7 Drawing Sheets

(A)

(B)

GAS DYNAMIC VIRTUAL NOZZLE FOR GENERATION OF MICROSCOPIC DROPLET STREAMS

CROSS-REFERENCE TO RELATED APPLICATIONS

This application claims the benefit of the filing date, under 35 USC §119(e), of U.S. Provisional Application Ser. No. 60/945,809, filed 22 Jun. 2007, which is hereby incorporated by reference in its entirety.

STATEMENT OF GOVERNMENT INTEREST

The invention described herein was made in part with government support under grant nos. 0429814 and DBI-0555845, awarded by National Science Foundation and award W911NF-05-1-0152 from the Army Research Office. The United States Government has certain rights in the invention.

FIELD OF THE INVENTION

This invention is related generally to methods and devices for forming streams of single-file sub-micron sized droplets, and uses thereof.

BACKGROUND OF THE INVENTION

Analysis and manipulation of particles, such as proteins or other biological molecules, often requires introducing or injecting the particle into vacuum, where the particle must maintain its native conformation. Examples of particle manipulation or analysis that may require particle injection into vacuum include molecular structure determination, spectroscopy, particle deposition onto a substrate (to produce, for example, sensor arrays), nanoscale free-form fabrication, formation of novel low temperature forms of particle-containing complexes, bombardment of particles by laser light, x-ray radiation, neutrons, or other energetic beams; controlling or promoting directed, free-space chemical reactions, possibly with nanoscale spatial resolution; and separating, analyzing, or purifying these particles.

Therefore, for many technological and scientific applications, the ability to form a single-file beam of microscopic liquid droplets is of great interest. Thus, methods and devices for providing streams of particles that are adapted for injection of the particle into vacuum would be of great benefit to these various fields.

SUMMARY OF THE INVENTION

In a first aspect, the invention provides a nozzle comprising, (i) a first tube comprising a first inner diameter, a first outer diameter, a first inlet orifice, and an outlet orifice; and (ii) a second tube comprising a second inner diameter; a second inlet orifice; an exit channel comprising an exit orifice comprising an exit diameter, a channel length, comprising the total distance from the first outlet orifice to the exit orifice; and a channel minimum diameter at a position along the channel length, wherein the channel minimum diameter is less than the second inner diameter, and a convergent section wherein the inner diameter of the second tube decreases from the second inner diameter to the channel minimum diameter; wherein the first tube is contained within the second tube; and the outlet orifice is within the convergent section and aligned with the exit orifice.

In a second aspect, the invention provides a method for producing a single-file stream of droplets comprising the steps of providing a nozzle according to the first aspect of the invention; injecting a first fluid through the first inlet orifice and a second fluid through the second inlet orifice, wherein the first and second fluids are both forced through the exit channel to produce a stream of the first fluid having a stream diameter less than the first inner diameter; the stream breaks up within the exit channel or downstream of the exit channel to produce a single-file stream of droplets; and the exit orifice outputs the fluid stream or the single-file stream of droplets.

In a third aspect, the invention provides an injector comprising (i) a chamber comprising a vacuum orifice and an injector orifice for injecting into the high-vacuum system, wherein the chamber is adapted for use with a high-vacuum analysis system; and (ii) a nozzle according to the first aspect of the invention, wherein the exit orifice of the nozzle outputs to the chamber and is essentially aligned with the injector orifice.

DETAILED DESCRIPTION OF THE INVENTION

The nozzle of the invention comprises two concentric tubes, a first and second tube, wherein separate fluids may be introduced into each tube and both fluids exit the nozzle through the same orifice in the second tube.

The first tube is the inner tube of the two concentric tubes. Each of the first and second tube comprise the same or differing materials, for example, one of both of the tubes may comprise glass or metal, such as stainless steel.

Each tube may have any geometric cross-section, however, it is preferred that each tube has an elliptical or circular cross-section. More preferably, each tube has a circular cross-section. For example, one or both of the first and second tubes is a capillary tube; preferably, each is a capillary tube.

Figure 1:
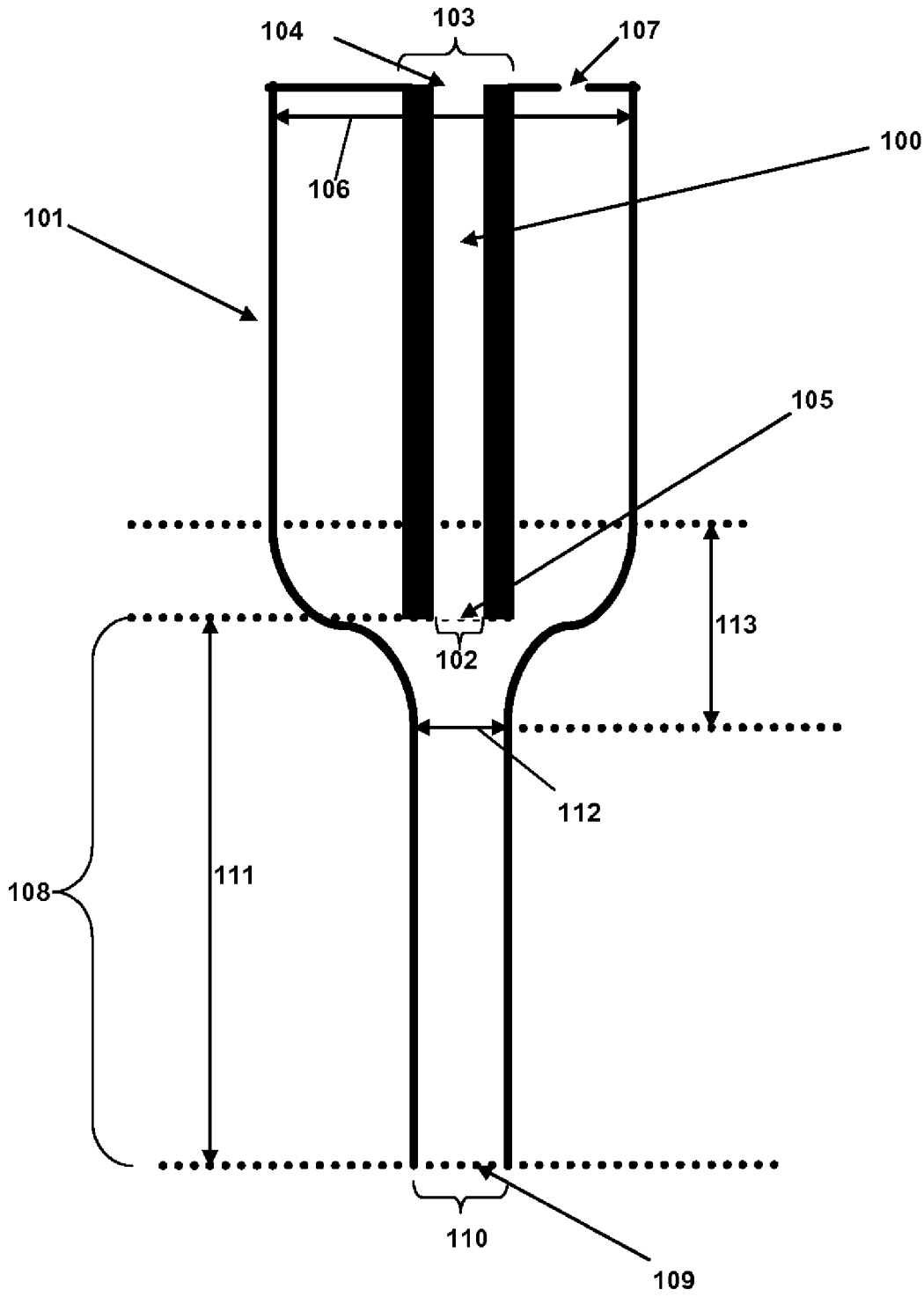
FIG. 1 is a graphical illustration of one embodiment of the nozzle of the invention.

One embodiment of the nozzle of the invention is shown in FIG. 1. In this embodiment, the nozzle comprises first (100) and second (101) concentric tubes. The first tube comprises a first inner diameter (102), a first outer diameter (103), a first inlet orifice (104), and an outlet orifice (105). The second tube comprises a second inner diameter (106); a second inlet orifice (107); and an exit channel (108). The exit channel comprises an exit orifice (109) comprising an exit diameter (110); a channel length (111), comprising the total distance from the first outlet orifice to the exit orifice; and a channel minimum diameter (112) at some position along the channel length wherein the channel minimum diameter is less than the second inner diameter (106). The second tube further comprises a convergent section (113) wherein the inner diameter of the second tube decreases from the second inner diameter (106) to the channel minimum diameter (112). In the nozzle of the invention, the outlet orifice (105) of the first tube is within the convergent section (113) of the second tube and aligned with the exit orifice (109).

The nozzle of the invention operates by providing a first fluid into the first inlet and a second fluid through the second inlet. A fluid cone of the first fluid emanates from the first outlet. In converging to pass through the exit orifice, the second fluid introduces dynamic forces on the first fluid, forcing the fluid cone of the latter to narrow significantly in diameter and neck down to a linear microthread. The microthread of the first fluid, which is smaller in diameter than either the first inner diameter or outlet orifice of the first tube or the fluid cone, persists downstream of the outlet orifice. The microthread eventually breaks up via Rayleigh instability yielding a linear stream of droplets of the first fluid that are smaller than the fluid cone from the first tube. Such breakup may occur within the exit channel or downstream of the exit orifice.

The fluid cone emanating from the outlet orifice of the first tube can wet the entire front of the tube, attaching at the larger first outer diameter rather than at the much smaller first inner diameter. In a preferred embodiment, the outlet orifice end of the first tube is beveled on the outside, tapering the first outer diameter to a sharp edge at the first inner diameter at the outlet orifice; when used, then a narrower fluid cone attaches at the first inner diameter at the outlet orifice.

In the convergent section of the second tube, the inner diameter of the second tube decreases from the second inner diameter to the channel minimum diameter. Preferably, the inner diameter of the second tube gradually decreases from the second inner diameter to the channel minimum diameter. More preferably, the inner diameter of the second tube smoothly decreases from the second inner diameter to the channel minimum diameter. Even more preferably, the inner diameter of the second tube gradually and smoothly decreases from the second inner diameter to the channel minimum diameter.

The fluid cone emanating from the outlet orifice of the first tube is reduced in diameter to the microthread diameter within an axial distance that is less than the characteristic gestation length for Rayleigh break-up of the microthread. Preferably, the reduction in diameter may be accomplished by use of a smoothly varying sidewall that is also as gradually varying as possible under the length constraint imposed by Rayleigh break-up. The smooth aerodynamic shape of the transition from the second inner diameter to the channel minimum diameter in the convergent section (i.e., the absence of any abrupt changes in sidewall radius or even of sudden changes in sidewall angle) allows maintenance of a laminar flow within the exit channel. Further, high pressure coaxial gas (50-60 psig) may be utilized without loss of the laminar flow in the exit channel. The stream of the fluids can follow the sidewall of the second tube which prevents the streamlines from "overshooting" on entry to the exit channel (i.e., vena contracts). Ultimately, laminar flow in the exit channel may be maintained, keeping the droplet beam in a straight-line form.

The exit channel may have a constant diameter from the channel minimum diameter to the exit orifice. Such a design of the nozzle of the invention is illustrated in FIG. 1. The channel minimum diameter may be greater than or equal to the first inner diameter. However, the channel minimum diameter may, in other embodiments of the nozzle of the invention, be less than the first inner diameter.

Preferably, the exit channel is tapered from a point of channel minimum diameter within the exit channel to the exit diameter, such that the exit diameter is greater than the channel minimum diameter. For example, in the vicinity of the exit orifice, the exit channel may make a transition from a smaller (channel minimum diameter) to a larger (exit diameter) and approximately constant diameter. This transition may involve an abrupt change in diameter, as defined herein, or an abrupt change in sidewall angle, or a smoothly-varying change in diameter, or some combination of these. More preferably, the exit channel is smoothly tapered from the channel minimum diameter to the exit diameter.

In a preferred embodiment, the converging section of the second tube and the exit channel diverging at the exit orifice introduces an "hourglass-shaped" constriction to the first and second fluids. Such a constriction by the exit channel has advantages over a simple channel and provides an increased density of droplets in the single-file stream produced by the nozzle of the invention.

In subsonic expansion an expanding fluid decelerates, in contrast to a supersonic expansion, in which the fluid accelerates. The cross-sectional area relief provided by an expanding exit orifice also alleviates boundary layer separation and thereby disruption of the laminar flow within the nozzle. As the fluids exit subsonically through the diverging section of the hourglass constriction, the second fluid and the droplets of the first fluid must slow, causing the spacing between droplets to decrease proportionally and thereby the linear density of droplets (droplets per unit length of beam) to increase.

Figure 2:
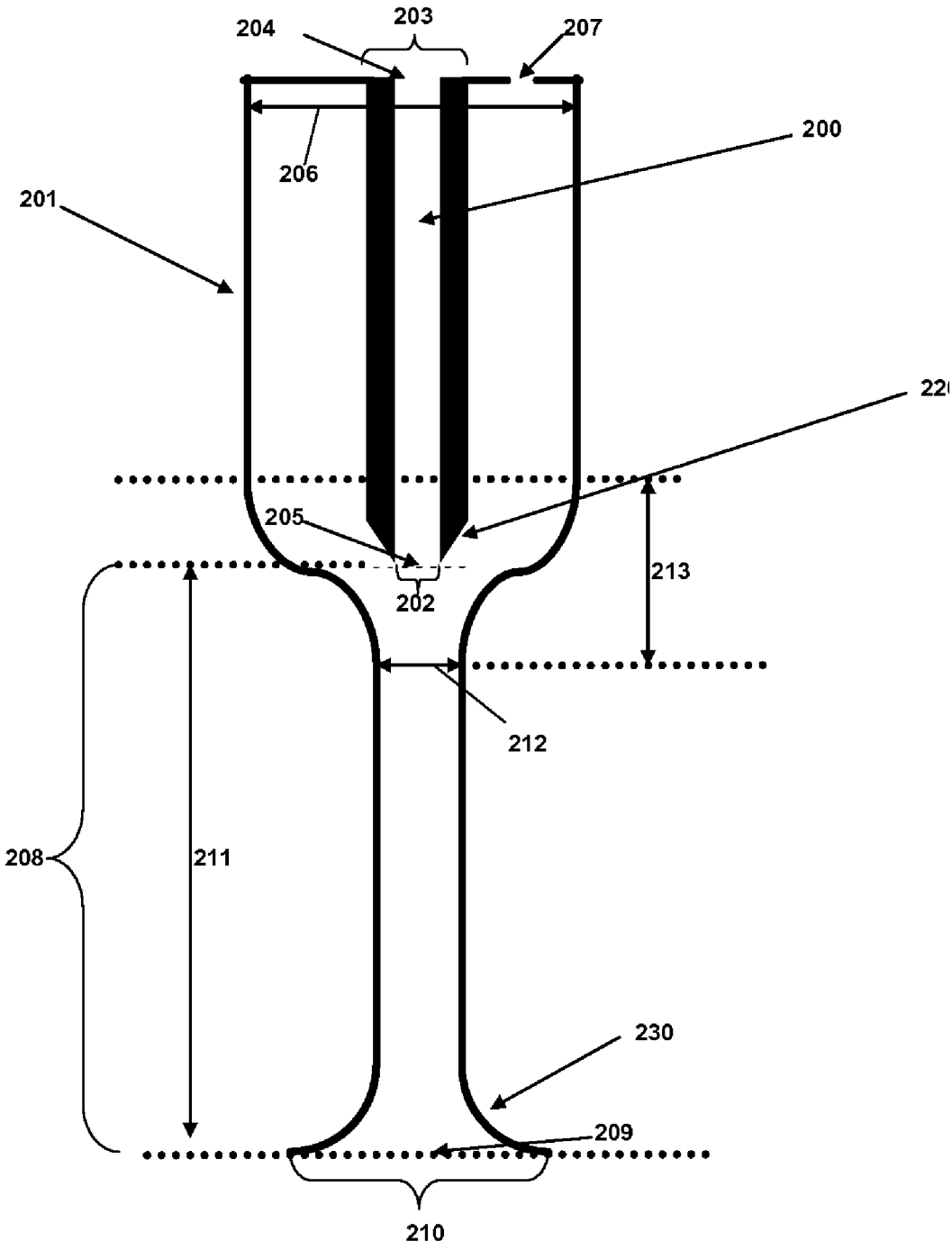
FIG. 2 is a graphical illustration of one embodiment of the nozzle of the invention wherein the first tube is tapered at its outlet end and has a divergent exit orifice.

FIG. 2 shows another preferred embodiment of the nozzle of the invention. In this embodiment, the nozzle comprises a first (200) and second (201) concentric tubes. The first tube comprises a first inner diameter (202), a first outer diameter (203), a first inlet orifice (204), and an outlet orifice (205). The first tube is tapered (220) such that the first outer diameter is approximately equal to the first inner diameter at the outlet orifice. The second tube comprises a second inner diameter (206); a second inlet orifice (207); and an exit channel (208). The exit channel comprises an exit orifice (209) comprising an exit diameter (210), a channel length (211), comprising the total distance from the first outlet orifice to the exit orifice; and a channel minimum diameter (212) at a position along the channel length wherein the channel minimum diameter is less than the second inner diameter (206). The exit channel is tapered (230) such that the exit diameter is greater than the channel minimum diameter. The second tube further comprises a convergent section (213) wherein the inner diameter of the second tube decreases from the second inner diameter to the channel minimum diameter; the outlet orifice (205) is within the convergent section (213) and aligned with the exit orifice (209).

Preferably, the first fluid comprises a liquid and the second comprises a gas. In certain preferred embodiments, the first fluid further comprises an analyte; such first fluids preferably comprise a heterogeneous or homogeneous solution, or particulate suspension of the analyte in the first fluid. Preferred first fluids include, but are not limited to liquids, for example, water and various solutions of water containing detergents, buffering agents, anticoagulants, cryoprotectants, and/or other additives as needed to form analyte-containing droplets while maintaining the analyte in a desired molecular conformation. Preferred analytes include, but are not limited to, proteins, protein complexes, peptides, nucleic acids (e.g., DNAs, RNAs, mRNAs), lipids, functionalized nanoparticles, viruses, bacteria, and whole cells. The first fluid may be supplied to the first tube by any methods known to those skilled in the art, for example, using a syringe pump. When the first fluid comprises a liquid, it is preferably supplied to the first tube at pressures ranging from about 2 to 35 times atmospheric pressure (about 15-500 psig); more preferably, at pressures ranging from about 10 to 20 times atmospheric pressure (about 135-275 psig); or pressures ranging from about 15 to 20 times (about 200-275 psig) atmospheric pressure.

Preferably, the second fluid comprises one or more inert gases; more preferably, the second fluid comprises hydrogen, nitrogen, carbon dioxide, helium, neon, argon, krypton, xenon, volatile hydrocarbon gases, or mixtures thereof. When the second fluid is a gas, it is preferably supplied to the second tube at pressures ranging from about 2 to 100 times atmospheric pressure (about 15-1500 psig); or about 2 to 50 times atmospheric pressure (about 15 to 750 psig); or about 2 to 25 times atmospheric pressure (about 15 to about 375 psig); or about 2 to 15 times atmospheric pressure (about 15-200 psig); or about 2 to 10 times atmospheric pressure (about 15-150 psig); more preferably, at pressures ranging from about 2 to 5 times atmospheric pressure (about 15-60 psig); or pressures ranging from about 3 to 5 times (about 25-60 psig) atmospheric pressure; or pressures ranging from about 5 to 100 times (about 60-1500 psig) atmospheric pressure; or about 5 to 50 times (about 60-750 psig) atmospheric pressure; or about 5 to 25 times (about 60-375 psig) atmospheric pressure; or about 5 to 15 times (about 60-200 psig) atmospheric pressure; or about 5 to 10 times (about 60-150 psig) atmospheric pressure; or pressures ranging from about 9 to 100 times (about 120-1500 psig) atmospheric pressure; or about 9 to 50 times (about 120-750 psig) atmospheric pressure; or about 9 to 25 times (about 120-375 psig) atmospheric pressure; or about 9 to 15 times (about 120-200 psig) atmospheric pressure.

The first inner diameter of the first tube may be about 0.1 μm to 100 μm; preferably, about 10 μm to 100 μm. The channel minimum diameter may be about 0.1 μm to 100 μm; preferably, about 10 μm to 100 μm. In other preferred embodiments, both the first inner diameter and channel minimum diameter may be each independently about 0.1 μm to 100 μm; more preferably, about 10 μm to 100 μm. The channel length is about 1 to 100,000 times the channel minimum diameter; preferably, about 10 to 100 times the channel minimum diameter.

In a preferred embodiment, the size of the droplets of the first fluid may be adjusted through evaporative shrinkage in the exit channel. For example, when the first fluid comprises a liquid (e.g., water) and an analyte (e.g., a protein, peptide, nucleic acid, lipids, and the like) and the second fluid a gas, each of the droplets of the first fluid produced by the nozzle of the invention will contain substantial volumes of the first fluid with respect to the analyte. Passage of the droplet stream through the exit channel with a high aspect ratio (e.g., when the exit channel has a channel length of greater than about 10 times the first inner diameter of the first tube; preferably, when the exit channel has a channel length of greater than about 10-100,000 times the first inner diameter of the first tube; more preferably, when the exit channel has a channel length of greater than about 10-100 times the first inner diameter of the first tube), allows for evaporation of nearly all of the first fluid from the droplets, resulting in a stream of droplets which essentially comprise the analyte. The gas pressure of the second fluid, temperature, and length of the exit channel (i.e., the aspect ratio) may be chosen to obtain the required first fluid evaporation and shrinkage in droplet size as the droplets pass through the exit channel.

In a more preferred embodiment, when the first fluid comprises water and an analyte (e.g., a protein, peptide, nucleic acid, lipids, and the like) and the second fluid a gas, then the exit channel has a channel length such that evaporation removes nearly all of the water from the droplets while retaining a water coating to maintain the analyte in a desired conformation.

Such evaporation is possible only in a high (ca. 1 atm) pressure, since droplets injected into vacuum cool so rapidly that they lose only a few percent of their mass before they cease to evaporate. On the other hand, droplets injected into a stagnant gas of high pressure rapidly decelerate due to aerodynamic drag and travel only a few centimeters or millimeters.

In another embodiment of the invention, the microthread or single-file stream of droplets generated by the nozzle of the invention may be injected into a 'waveguide' capillary tube. The capillary tube may be linear or non-linear in extent and about 1 to 100 cm long; the preferred length is about 1-10 cm. When the microthread is injected into the capillary tube, the microthread may break up within the capillary via Rayleigh instability, yielding a single-file stream of droplets which travel through the capillary and out of its exit. This injection and transmission occurs even when the capillary is microscopic in inner diameter (e.g., about 10-100 μm), very long (e.g., 1-10 cm), and even bent through a significant radius of curvature (e.g., 10-100 cm). Effectively, the capillary behaves as a waveguide for the droplet stream.

By injecting the microthread into a 'waveguide' capillary, the requisite high pressure and co-flowing second fluid with the droplet stream of the first fluid allows for evaporation of the first fluid from the droplets, as discussed previously. The gas pressure of the second fluid, temperature, and length of the waveguide capillary may be chosen to obtain the required first fluid evaporation and shrinkage in droplet size as the droplets pass through the capillary.

The exit end of the 'waveguide' capillary may be tapered to form a convergent exit opening (e.g., about 10 to 100 μm, preferably about 10-20 μm inner diameter), thereby physically forcing the gas flow (with entrained droplets of the first fluid) down to this size. Thus, a high concentration of single droplets may be produced within a volume having a lateral extent of about the diameter of the capillary exit.

In other embodiments, the exit channel of the second tube may be non-linear between the outlet orifice of the first tube and the exit orifice, provided that the outlet orifice of the first tube is aligned with the convergent section of the second tube. Due to the laminar flow within the exit channel, the exit channel behaves as waveguide for the droplet stream.

Figure 3:
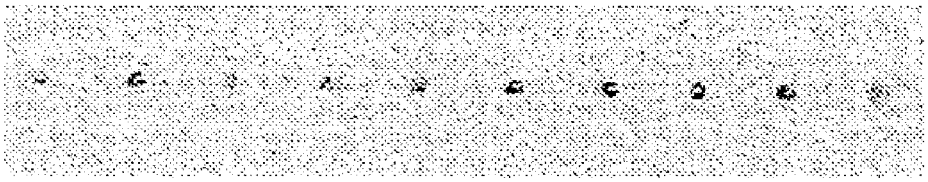
FIG. 3 is a picture comparing the general morphology and spacing of water droplets in a stream of droplets produced by the nozzle of the invention with (A; 405 kHz) and without triggering (B) by acoustic vibration. The nozzle used to produce the streams had an inner capillary I.D. of 50 μm and an exit orifice diameter of 100 μm. For each stream, the water pressure was 25 psi and gas pressure was 5 psi.
Figure 3:
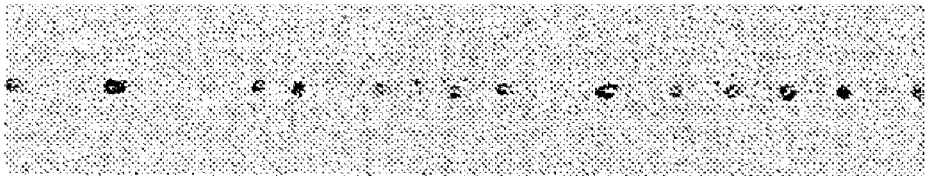

The nozzle of the invention may further provide one or more additional elements including an oscillator for introducing controlled acoustic oscillations into one or more fluids passing through the nozzle, a heater for heating the nozzle, and/or a cooler for cooling the nozzle. Controlled acoustic oscillations can be introduced into one or more fluids passing through the nozzle include, for example, a piezoelectric oscillator; pulses of radiant energy, including heat and laser pulses; electric field pulses; and magnetic field pulses. Rayleigh break-up of a conventional liquid jet can be triggered by exciting the nozzle assembly with an acoustic vibration of the desired frequency. A piezoelectric oscillator may be attached to the outer wall of the nozzle of the invention, and triggers, as demonstrated in FIG. 3, a periodic, single-file stream of droplets (preferably, monodisperse with respect to droplet diameter). The piezoelectric oscillator may alternatively be in direct contact with the first fluid (e.g., liquid), as far upstream as the reservoir that supplies the first tube, or attached to the first tube or housing which provides the second fluid (e.g., gas) to the second tube. The piezoelectric oscillator may generate a frequency ranging from about 10-1000 kHz; preferably, piezoelectric oscillator may generate a frequency ranging from about 10-500 kHz; 10-400 kHz; 10-300 kHz; 10-200 kHz; or about 50-100 kHz; or about 100-200 kHz. In one specific example the piezoelectric oscillator may generate a frequency of about 73 kHz. In another specific example the piezoelectric oscillator may generate a frequency of about 169 kHz.

The nozzle can be heated by, for example, but not limited to, resistive heating tapes, infrared and microwave heating sources, induction heating, bombardment with electrons or other charged particles, and convective or conductive heat transfer from a hot gas or liquid. The second tube itself may be resistively heated by providing a current through a selected portion of the tube through attachment and/or incorporation of conductive elements (e.g., metal contacts, conductive glasses, such as, indium-tin-oxide) onto and/or into the second tube. One skilled in the art readily recognizes that the degree of heating provided (i.e., the temperature of the nozzle) may be controlled by selection of the electrical current passed through and/or electrical voltage applied across the heating element. The heater may heat the entire nozzle and/or only the exit channel portion of the nozzle. In certain embodiments, the heater heats at least the exit channel portion of the nozzle. In other embodiments, the heater heats only the exit channel portion of the nozzle. When the nozzle further comprises a 'waveguide' capillary, then the heater preferably heats at least the exit channel portion of the nozzle and/or the 'waveguide' capillary.

The nozzle can be cooled by, for example, but not limited to, convective or conductive heat transfer to a cold gas or liquid including cryogenic gases and liquids, thermoelectric cooling (Peltier devices), and refrigeration cooling including both conventional and cryogenic refrigerants.

In a second aspect, the invention provides a method for producing a single-file stream of droplets comprising the steps of providing a nozzle according to the first aspect of the invention; injecting a first fluid through the first inlet orifice and a second fluid through the second inlet orifice, wherein the first and second fluids are both forced through the exit channel to produce a stream of the first fluid having a stream diameter less than the first inner diameter; the stream breaks up within the exit channel or downstream of the exit channel to produce a single-file stream of droplets; and the exit orifice outputs the fluid stream or the single-file stream of droplets.

As discussed previously, the nozzle of the invention operates by providing a first fluid into the first inlet and a second fluid through the second inlet. A fluid cone of the first fluid emanates from the first outlet. In converging to pass through the exit orifice, the second fluid dynamic forces on the first fluid, forcing the latter to narrow significantly in diameter and neck down to a linear microthread. This microthread of the first fluid, which is significantly smaller in diameter than either the first inner diameter of the first tube or the outlet orifice, persists downstream of the outlet orifice. The microthread eventually breaks up via Rayleigh instability yields a linear stream of droplets that are smaller than the parent jet from the first tube. Such breakup may occur within the exit channel or downstream of the exit orifice.

Preferably, the first fluid comprises a liquid and the second comprises a gas. In certain preferred embodiments, the first fluid further comprises an analyte; such first fluids preferably comprise a heterogeneous or homogeneous solution, or particulate suspension of the analyte in the first fluid. In such cases, the nozzle produces a stream of droplets of the first fluid. The first fluid may be supplied to the first tube by any methods known to those skilled in the art, for example, using a syringe pump.

Preferably, the droplets formed according to the methods of the invention have a diameter of less than 20 μm. More preferably, the droplets have a diameter of less than 19 lam, 18 μm, 17 μm, or 16 μm. Even more preferably, the droplets have a diameter of less than 15 μm, 14 μm, 13 μm, 12 μm, 11 μm, 10 μm; 9 μm, 8 μm, 7 μm, 6 μm, 5 μm, 4 μm, 3 lam, 2 μm, or 1 μm, or 100 nm. In other embodiments, the droplets formed according to the methods of the invention have a diameter ranging from about 1 to 20 μm, or about 1 to 19 μm; or about 1 to 18 μm; or about 1 to 17 μm; or about 1 to 16 μm; or about 1 to 15 μm; or about 1 to 14 μm; or about 1 to 13 μm; or about 1 to 12 μm; or about 1 to 11 μm; or about 1 to 10 μm; or about 1 to 9 μm, or about 1 to 8 μm; or about 1 to 7 μm, or about 1 to 6 μm; or about 1 to 5 μm, In other embodiments, the droplets formed according to the methods of the invention have a diameter ranging from about 100 nm to 20 μm, or about 100 nm to 19 μm; or about 100 nm to 18 μm; or about 100 nm to 17 μm; or about 100 nm to 16 μm; or about 100 nm to 15 μm; or about 100 nm to 14 μm; or about 100 nm to 13 μm; or about 100 nm to 12 μm; or about 100 nm to 11 μm; or about 100 nm to 10 μm; or about 100 nm to 9 μm, or about 100 nm to 8 μm; or about 100 nm to 7 μm, or about 100 nm to 6 μm; or about 100 nm to 5 μm, In a third aspect, the invention provides injectors comprising a chamber comprising a vacuum orifice and an injector orifice, wherein the chamber is adapted for use with a high-vacuum analysis system; and a nozzle according to the first aspect of the invention, wherein the exit orifice of the nozzle outputs to the chamber and is essentially aligned with the injector orifice.

The injector of the invention allows for the single-file stream of droplets of the first fluid and/or analyte to be injected into a high vacuum (HV) or even ultra-high vacuum (UHV) for analysis. Expansive cooling of the single-file stream of droplets is achieved by the nozzle of the invention by injection into a vacuum; doing so is accomplished without compromising the vacuum by generation of droplets that are sufficiently small (preferably the droplets have a diameter of less than about 10 μm; more preferably, less than about 1 μm; even more preferably, less than about 100 nm) or sufficiently cold (preferably at or below the temperature at which the equilibrium vapor pressure equals the desired vacuum pressure; for water droplets this is −75° C. for HV applications and −120° C. for UHV applications) that their evaporative gas load can be handled by the vacuum pumps.

In operating the injector of the invention, a vacuum is maintained in the chamber via the vacuum orifice and a stream of droplets is provided by the nozzle as discussed previously. Preferably, the vacuum in the injector is maintained at a level less than or equal to the vacuum maintained within the high-vacuum system. For example, the vacuum in the injector is maintained at about $10^{-3}$ to $10^{-7}$ mbar. In an embodiment of the invention, the injector of the invention further comprises a vacuum pump for providing a vacuum in the first chamber via the vacuum orifice.

In a preferred embodiment of the third aspect, the injector orifice comprises a simple aperture. In another preferred embodiment of the third aspect, the injector orifice comprises a tube. In a more preferred embodiment of the third aspect, the injector orifice further comprises a molecular beam skimmer.

Figure 4:
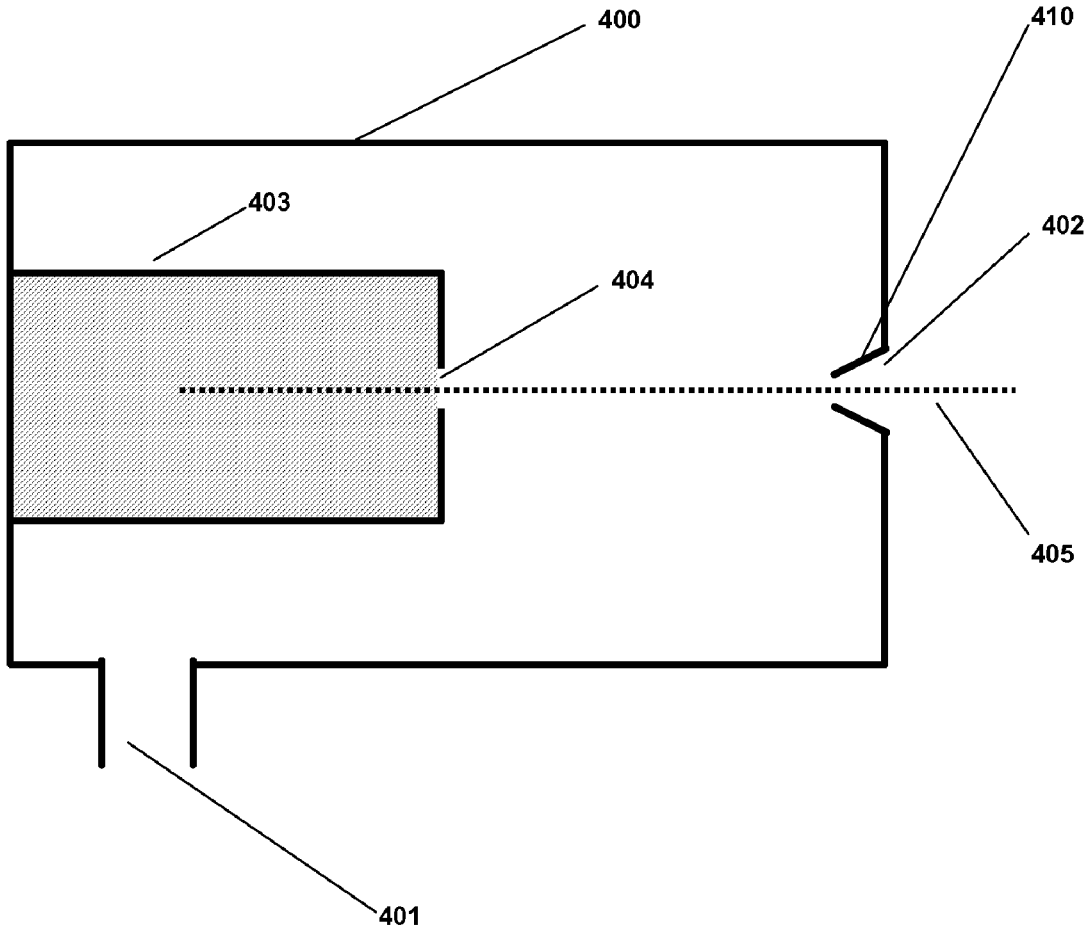
FIG. 4 is a graphical illustration of one embodiment of the injector of the invention.

A schematic depiction of one embodiment of an injector of the invention is shown in FIG. 4. The injector of FIG. 4 includes a chamber (400) comprising a vacuum orifice (401) and an injector orifice (402) for injecting into the high-vacuum system; and a nozzle according to the first aspect of the invention (403), wherein the exit orifice of the nozzle (404) outputs to the chamber and is essentially aligned (405) with the injector orifice (402), where the injector orifice further comprises a molecular beam skimmer (410).

The injector of the invention may further comprise an aligner for aligning the exit orifice of the nozzle with the injector orifice. Such aligners include mechanical alignment, such as via thumbscrews, or mechano-piezoelectric devices, such as precision mechanical drives or precision piezoelectric drives that move the capillary laterally and axially with respect to the injector orifice. The aligner may be sealed within the assembly which comprises the injector of the invention and/or pass through vacuum seals, so that the only physical communication between the nozzle and the surrounding plenum is via the nozzle exit orifice and the only physical communication between the plenum and the surrounding ambient is via the injector orifice.

DEFINITIONS

The term "diameter" as used herein means the linear distance defined by the maximum transverse extent of the cross-section of the object. For example, if an object has an elliptical cross-section, then the diameter of the object is defined by the major axis of the ellipse cross-section; if an object has a square cross-section, then the diameter is defined by the diagonal of square cross-section.

The term "tube" as used herein means a hollow elongated object having inner and outer diameters, as defined herein and a cross-section which is not limited by geometric shape. Preferably, a tube has a circular or elliptical cross-section.

The "exit diameter" as used herein means the diameter of the exit channel near or at the exit orifice as follows: when the exit diameter is essentially the same as the channel minimum diameter (e.g., within +/−10%, preferably +/−5%), then the exit diameter is the diameter of the exit channel at the exit orifice; when the exit diameter is greater than the channel minimum diameter, then the exit diameter is the diameter of the cross-sectional area at the position where the cross-sectional area of the exit channel has first increased to at least 90% of its value at the exit orifice. However, when there is an abrupt (i.e., discontinuous) increase in cross-sectional area of the exit channel to at least 90% of its value at the exit orifice, then the exit diameter is the diameter of the cross sectional area immediately upstream of the abrupt change.

The term "aligned" as used herein with respect to two orifices means that the vector at the center of a first orifice and normal to the plane defined by the first orifice intersects the plane defined by the second orifice. Preferably, the vector at the center of a first orifice and normal to the plane defined by the first orifice intersects and is essentially normal (e.g., 90°+/−10°, preferably +/−5°) to the plane defined by the second orifice. More preferably, the vector at the center of a first orifice and normal to the plane defined by the first orifice intersects and is essentially normal to the plane defined by the second orifice, and intersects the plane defined by the second orifice within the boundary of the second orifice.

The term "essentially aligned" as used herein with respect to two orifices means that the vector at the center of a first orifice and normal to the plane defined by the first orifice intersects and is essentially normal (e.g., 90°+/−10°, preferably +/−5°) to the plane defined by the second orifice, and intersects the plane defined by the second orifice within the boundary of the second orifice. More preferably, the vector at the center of a first orifice and normal to the plane defined by the first orifice is essentially normal to the plane defined by the second orifice and intersects the plane defined by the second orifice essentially at the center (e.g., within 10% the total diameter of the orifice; preferably, within 5%) of the second orifice.

The term "approximately equal" as used herein means that the two values differ by less than about 10%. More preferably, the two values differ by less than 5%.

The term "high-vacuum" as used herein means the pressure range from $10^{-3}$ mbar to $10^{-7}$ mbar ($10^{-6}$ atm to $10^{-10}$ atm).

The term "ultra high vacuum" as used herein means the pressure range below $10^{-7}$ mbar ($10^{-10}$ atm).

The term "molecular beam skimmer" as used herein means a slender conical shell that is truncated at its apex to yield a circular aperture and fabricated such that the edge of this aperture is extremely sharp, preferably having a radius of curvature of only a few microns.

The term "gradually" as used herein means that the channel diameter D changes only slowly per unit axial length z, i.e. that the slope dD/dz of the sidewall profile is small at all points, preferably small enough to maintain steady laminar flow everywhere within the fluid and to avoid separation or re-circulation of the flow at any point.

The term "smoothly" as used herein means no discontinuities in the sidewall profile, either in diameter D and or in slope dD/dz, i.e., being the representation of a function D(z) with a continuous first derivative.

The term "inert gas" as used herein means a gas which will not cause degradation or reaction of the fluids and/or any analytes. Such gases preferably contain limited levels of oxygen and/or water; however, the acceptable level of water and/or oxygen will depend on the fluids and/or analytes, and is readily apparent to one skilled in the art. Such atmospheres preferably include gases such as, but are not limited to, nitrogen, helium, and argon, and mixtures thereof.

The term "monodisperse" as used herein means the diameters of the particles or droplets differ by less than 30%; more preferably, less than 10%.

EXAMPLES

Example 1

Procedure for Making a Nozzle Assembly

As an illustrative example, the procedure for fabricating one version of the nozzle is as follows. A commercial hollow-core fused silica optical fiber (Polymicro Technologies LLC, Phoenix, Ariz.) of 360 μm OD and 20-50 μm ID was employed as the first (inner) tube. A commercial borosilicate glass capillary of 1.2 mm OD and 0.9 mm ID (Sutter Instrument, Novato, Calif.) was employed as the second (outer) tube.

(1) To form the exit channel on the second (outer) tube, the tube was held vertically and the bottom of the tube heated from below with a standard propane torch. The tube was rotated slowly about its axis during this heating in order to maintain a radially symmetric shape. The sidewall of the tube thickens at the tube end and automatically forms a converging exit channel of the desired smoothly-varying aerodynamic shape. To prevent the sidewall from collapsing to full closure, gas can be blown through the capillary tube during heating if desired. This was generally not necessary when heating with a propane torch, but may be necessary if a hotter (oxy-acetylene) torch is used. The required air flow can be generated by simply blowing by mouth into a connecting tube attached to the distal capillary tube (a standard glass-blowing technique). Alternatively, an appropriate gas flow can be generated at either a set flow-rate or set pressure from a gas tank.

(2) An external taper was cut onto the front end of the first (inner) tube by bringing one end of the hollow-core optical fiber end into contact with a grinding wheel at an oblique angle. This contact angle was chosen to give the desired angle of taper, and the optical fiber was also rotated slowly about its axis during the grinding. Grinding disks of 30 μm to 3 μm, but optionally 9 μm, grit have been used successfully. Alternatively, commercial capillary tubes can be ordered with a front end already ground to a taper by the supplier.

(3) A commercial PEEK tubing sleeve of 635 μm OD and 394 μm ID was slid onto the optical fiber and positioned about 1.5 cm back from the nozzle end. This is a close, barely sliding fit, and provides a "stop" for a PTFE sleeve of 830 μm OD and 380 μm ID and about 1 cm length that was subsequently slid (very carefully) onto the optical fiber over the nozzle end. This second sleeve centers the inner tube within the outer, to accurately align the tapered nozzle on the first (inner) tube with the exit channel on the second (outer) tube. If desired, this wall of this sleeve may be carefully shaved down at two or more locations along its periphery, to provide clearance for the gas flow through the second (outer) tube. In general this is not necessary: The loose sliding fit of the sleeve into the second (outer) tube provides sufficient clearance (nominally 635 μm OD vs. 700 μm ID of the second tube) for the gas flow in and of itself, yet without compromising the transverse alignment.

(4) The two tubes were assembled by either, (i) with the alignment sleeve in place, the inner and outer tubes were positioned axially to give a desired separation between capillary exit (outlet orifice) and nozzle exit channel. A 100 μm ID capillary tube was inserted into the distal end of the gas plenum, providing a connection through which gas could be supplied to the plenum, and the tubes were then permanently glued together and sealed with a drop of epoxy at this junction, or (ii) the outer housing was mounted into one end of the straight-run through a 3-way cross, making use of a standard HPLC compression fittings for the 1.2 mm OD tube to do so. The second (outer) tube terminates in the cross and the first (inner) tube passes through the straight-run and out the far end of the cross. The distance between the end of the tapered nozzle and the opening of the exit channel was adjusted as desired, and the first (inner) tube was fixed and sealed into place at the straight-run exit by means of a standard HPLC compression fitting for the 360 μm OD optical fiber.

(5) The desired driving gas, from a pressurized tank via an appropriate gas regulator, was connected to the side run of the 3-way cross. The desired droplet liquid was connected to the distal end of the first (inner) tube, generally by means of a syringe pump.

(6) Optionally, a small piezoelectric actuator can be clipped to the outside of the outer glass tube of the nozzle to applying a periodic acoustic signal at a frequency near the spontaneous break-up frequency to trigger free-running droplet beam sources. It was not obvious at the outset, however, that droplet generation could be triggered in the nozzle in this fashion: The applied acoustic signal could only reach the liquid jet circuitously, either traveling through the gas flow surrounding the liquid jet or via a long mechanical pathway to the rear of the outer tube and then back forwards through the inner tube.

(7) This assembly was mounted in the appropriate apparatus for use in vacuum or in an ambient gas, as desired

Example 2

Operation

Figure 5:
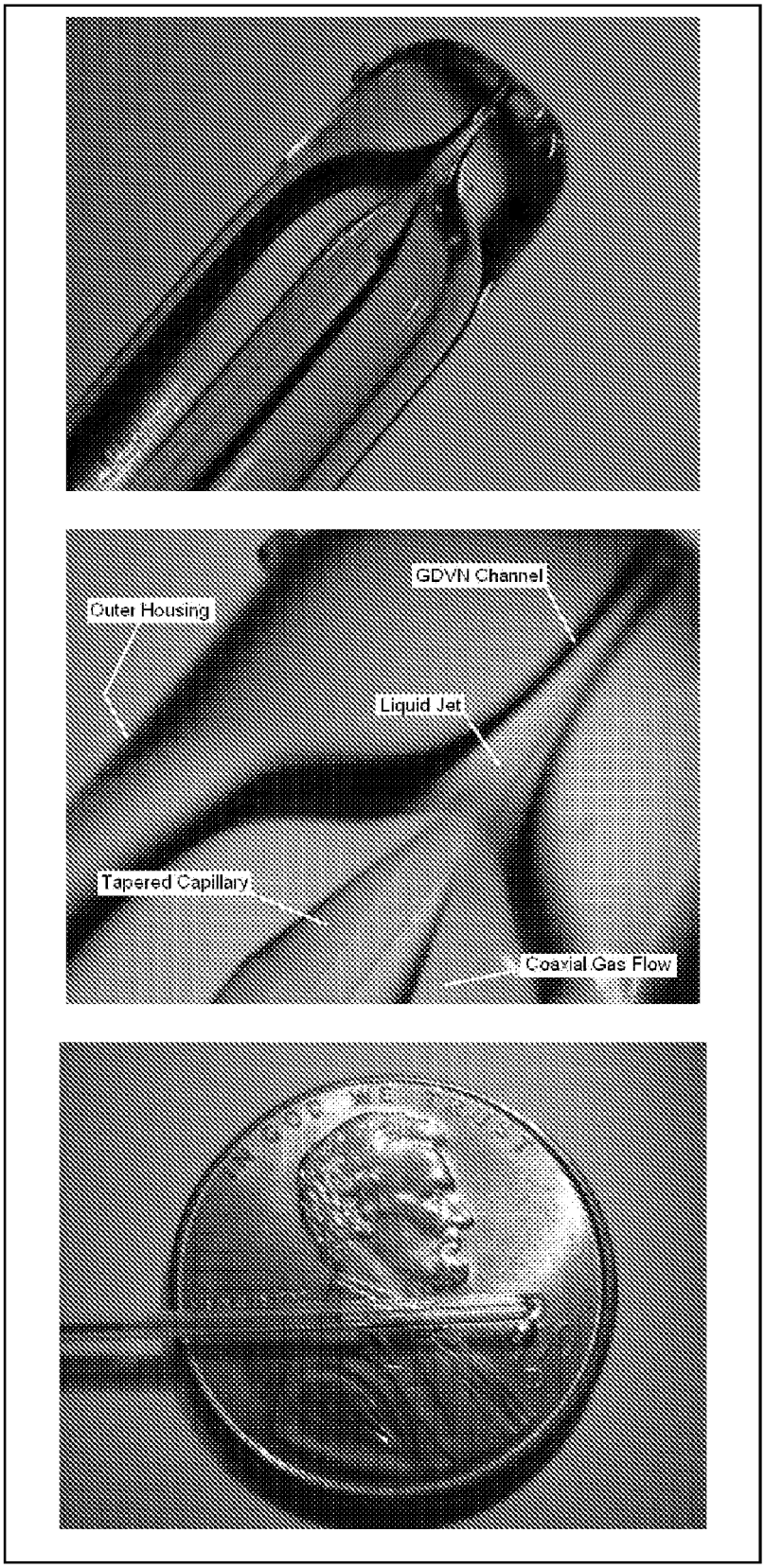
FIG. 5 is a photograph of a nozzle of the invention. Top image: The region near the tip of the tapered first (inner) tube and the smoothly-converging exit of the second (outer) tube. Middle image: Enlarged view of the water cone emerging from the tapered first (inner) tube, with the various components labeled. Bottom image: Photograph of one such nozzle laid on top of a penny, to emphasize the miniature scale of the device

A photograph of a working nozzle fabricated according to this procedure is provided in FIG. 5. Top image: The region near the tip of the tapered first (inner) tube and the smoothly-converging exit of the second (outer) tube. Often the first tube is positioned even much closed to the minimum diameter of the exit channel. Middle image: Enlarged view of the water cone emerging from the tapered first (inner) tube, with the various components labeled. Bottom image: Photograph of one such nozzle laid on top of a penny, to emphasize the miniature scale of the device.

The PTFE sleeve that centers the inner capillary tube within the outer glass housing lies just above the top of the photograph and so is not seen in this photograph. Sample liquid was supplied to the inner capillary via either a syringe pump (low pressure operation) or a gas-pressurized liquid reservoir (high pressure). The liquid jet emanating from the 50 μm ID inner tube is accelerated by the gas flowing through the surrounding outer tube and necks down to exit the nozzle exit channel with a much smaller diameter than that of the liquid supply tube. Accordingly, gas dynamic compression is seen to work quite effectively even in this geometry.

Microfluidic devices generally exhibit rather complex flow behavior as a function of drive pressure and our nozzle was no exception, with both gas pressure and liquid pressure playing a role. Three principal regimes of behavior were observed:

(1) "Dripping"—At low liquid and low gas pressures, large single drops were emitted from the exit orifice of the nozzle exit channel, varying from 5 to 50 μm in diameter. Doublets or higher order multiplets of droplets were emitted under certain operating conditions, often in such a fashion that the individual multiplet droplets coalesced further downstream. The details of these emission and coalescence events could be extremely regular from one to the next.

(2) "Unsteady dripping"—At higher gas pressure but still low liquid pressure, a long, slender column of liquid was periodically emitted. This column then broke up in flight via Rayleigh instability to yield a finite linear train of droplets.

(3) "Jetting"—At still higher liquid pressure, a continuous microthread of liquid emerged and underwent Rayleigh break-up to yield a continuous, single-file train of droplets. When using longer liquid supply lines, the pressure necessary to reach the jetting regime was beyond the capacity of a syringe pump and so required use of the gas-pressured liquid reservoir. With a 50 μm ID capillary of 50 cm length from reservoir to capillary exit, 250 psi at the liquid reservoir was typically required to reach. Even higher pressures were needed for jetting from smaller diameter or longer tubes. There was considerable hysteresis in the dripping-to-jetting transition, the transition taking place at higher values as the liquid pressure was being raised than when it was being lowered.

Operation at too low or too high a gas pressure yielded unsatisfactory behavior regardless of liquid pressure. Gas dynamic compression clearly must fail at overly low gas pressure, which allows the liquid emerging from the inner capillary to fill the entire nozzle exit channel. At very high pressure the liquid jet would come into contact with the sidewall of the exit channel—presumably due to Venturi or inertia effects—and this also disrupted the flow.

Example 3

Results

Figure 6:
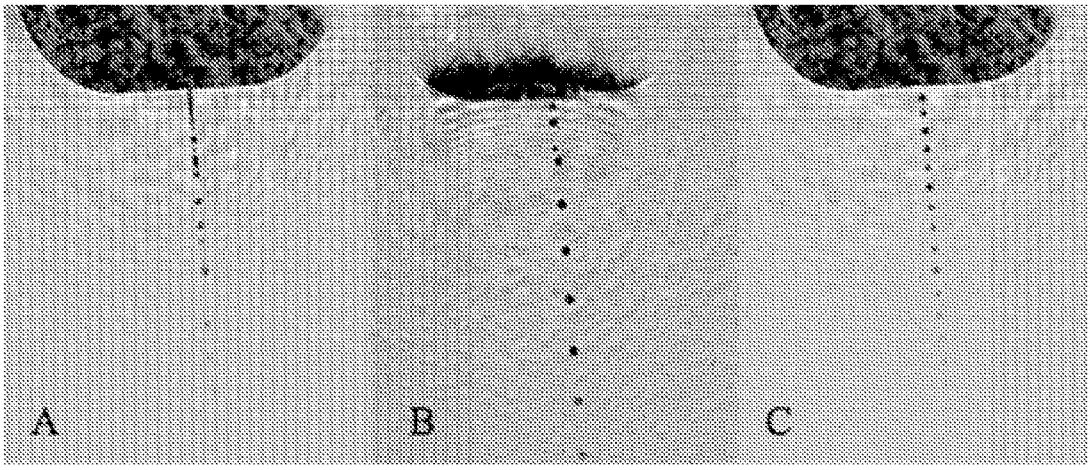
FIG. 6 shows single-shot images of an embodiment of the nozzle of the invention in operation, injecting a microthread of water into stagnant air. The front of the 1.2 mm OD outer housing appears as the dark object at the top of this background-subtracted image. Parameters: 160 ns exposure time, 50 μm ID liquid capillary, 60 μm ID exit channel, 35 μL/min flow rate, 25 psi gas pressure, 250 psi water pressure). (a) Untriggered operation showing spontaneous break-up. (b) Break-up triggered at 73 kHz. The droplet diameter is 25 μm. Droplet speeds computed from the image scale and trigger frequency are 9 msec (at exit of nozzle channel) and 13 m/sec (1100 μm downstream of exit). (c) Break-up triggered at 169 kHz. The droplet diameter is 25 μm. Droplet speeds computed from the image scale and trigger frequency are 9 msec (at the exit orifice of the nozzle exit channel) and 13 msec (880 μm downstream of exit orifice).
Figure 7:
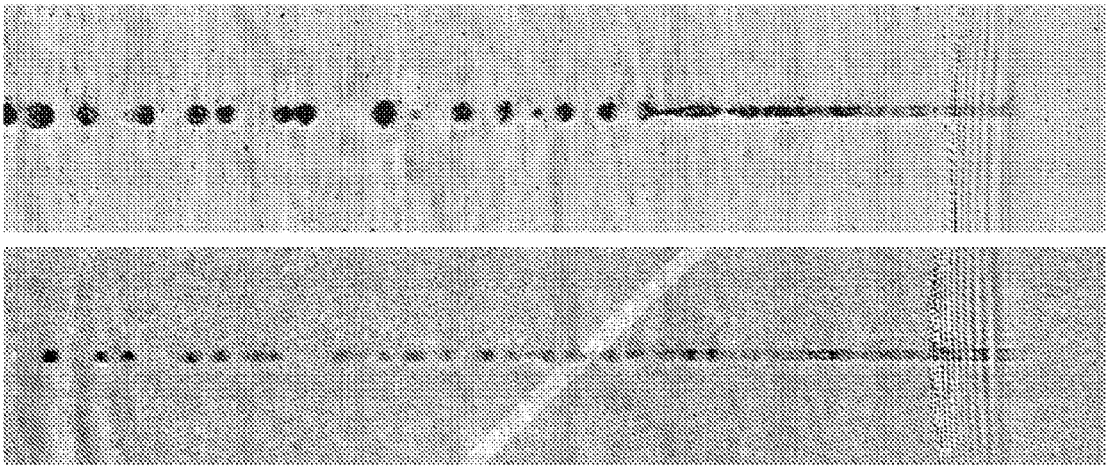
FIG. 7 shows the effect of coaxial gas pressure on droplet size for untriggered break-up in vacuum. Top: At low gas pressure the droplet diameter is about twice that of the continuous jet, as in conventional Rayleigh break-up (55 psi gas pressure, 240 psi water pressure, jet diameter ~6 μm, mean droplet diameter ~13 μm). Bottom: At high pressure the droplets are smaller, having about the same diameter as the unbroken jet, probably a result of shear forces exerted on the liquid by the gas (120 psi gas pressure, 240 psi water pressure, jet diameter and mean droplet diameter both ~6 μm)

An optical microscopy system for recording fast single-shot images of droplet streams. (see, Weierstall et al., Exp. Fluids DOI 10.1007/s00348-007-0426-8 (2007) and in press (2007)) was employed to recording fast single-shot images of the droplet trains generated by the nozzle under various operating conditions. Several such images are shown in FIGS. 6 and 7. Of particular interest was the observation that the nozzle could be "triggered" by an acoustic vibration applied to the outer glass tube. This is illustrated in FIG. 6 for operation in the jetting regime with (a) spontaneous break-up in the absence of an applied acoustic vibration, (b) break-up in the presence of a 73 KHz vibration, and (c) break-up in the presence of a 169 kHz vibration. Untriggered, the initial columnar jet extends beyond the exit orifice of the nozzle exit channel as observed in FIG. 6(*a*). With the acoustic trigger signal applied, FIGS. 6(*b*) and (*c*), the break-up point moves upstream into the nozzle exit channel and the droplet train becomes monodisperse and periodic. The spacing and size of the droplets varies accordingly, as dictated by continuity for a given flow velocity. Triggering in this manner was possible only in the jetting regime and only for low gas pressures. In the dripping regime, triggering was not possible nor was it possible to produce a uniform droplet size.

Also of considerable interest was the variation in flow morphology as the driving pressure of the coaxial gas flow was increased. This is illustrated in FIG. 7. At low gas pressures, FIG. 7(*a*), the droplet diameter was roughly twice that of the columnar parent jet, consistent with Rayleigh break-up triggered at about the spontaneous break-up frequency. At high gas pressure (high We) this was no longer the case; rather the droplet diameter was seen, FIG. 7(*b*), to be roughly equal to the jet diameter. This is likely the result of shear forces arising at the free boundary of the liquid jet when operating at the higher gas velocities. These forces become the dominant driving force, and triggering by application of an external acoustic signal is no longer possible.

The nozzle of FIG. 5 has been successfully operated under HV conditions by surrounding the nozzle with a differential pumping plenum. The small size of the device greatly facilitates this. In fact, the entire nozzle system of FIG. 5 can replace a single capillary Ganan-Calvo design, with the gas plenum of that source being used as differential pumping stage and the droplet beam from the nozzle exit orifice exiting through the flat-plate orifice into vacuum. Alternatively, a condensable gas may be used as the nozzle coaxial gas flow. Using a liquid nitrogen-cooled coil cold trap, we obtain operating pressures to order of $10^{-5}$ Torr in a 10 L vacuum chamber with an estimated pumping speed of 700 L/s. When run in vacuum, the exit channel of the nozzle is cooled by the free expansion of the outflowing coaxial gas. This can lead to ice formation in the nozzle exit channel if the liquid jet momentarily contacts exit channel wall, for example on startup when air bubbles in the liquid line disrupt the liquid flow. Heating the nozzle to remove the ice generally restores normal operation.

We have not yet determined exactly how small a droplet can be produced with our nozzle. The device appears to run in a mode in which liquid is passing out of the nozzle and can be collected downstream, yet no droplets are seen in an optical microscope. This would be the case if droplets were too small to be resolved by visible light. We have very recently run our nozzle successfully in a scanning electron microscope (SEM), imaging microjets of water via electron scattering rather than visible light, and hope to test the limits on droplet size using this much higher resolution imaging.

When operated in air, the distance over which the droplets maintain a straight-line stream decreases with increasing gas pressure. This may be due to the lower inertia of smaller drops as well as increasing effect of turbulence at the higher Reynolds number (see, Ganan-Calvo and Barrero, J. Aerosol Sci. 30, 117-125 (1999)). When operated in vacuum at $10^{-5}$ Torr, the expanding nozzle gas quickly rarefies to the point of free molecular flow (see, H. Pauly, *Atom, Molecule, and Cluster Beams* (Springer, Berlin, 2000)). Under these conditions, the straight-line form (more exactly, the parabolic path in the gravitational field) persists from a few mm to greater than the length or our apparatus (30 cm) depending on the diameter of the jet and proximity of the point of jet break up to the exit orifice. Jets, which break up well within the exit orifice, may deviate from straight-line form upon exiting the orifice.

Slight misalignment of the liquid nozzle within the gas aperture limits our ability to further stretch the jet by increasing the gas pressure: As the gas pressure increases, the Venturi effect causes a drop in gas pressure at the side of the jet which is closer to the exit channel sidewall, deflecting the jet to this side to eventually attach to the sidewall.

We claim:

1. A nozzle comprising, (i) a first tube comprising a first inner diameter, a first outer diameter, a first inlet orifice, and an outlet orifice; and (ii) a second tube comprising a second inner diameter; a second inlet orifice; an exit channel comprising an exit orifice comprising an exit diameter, a channel length, comprising the total distance from the first outlet orifice to the exit orifice; and a channel minimum diameter at a position along the channel length wherein the channel minimum diameter is less than the second inner diameter, and a convergent section wherein the inner diameter of the second tube decreases from the second inner diameter to the channel minimum diameter;

wherein the first tube is contained within the second tube; and the outlet orifice is within the convergent section and aligned with the exit orifice.

2. The nozzle of claim 1, wherein in convergent section, the inner diameter of the second tube gradually decreases from the second inner diameter to the channel minimum diameter.

3. The nozzle of claim 1, wherein in convergent section, the inner diameter of the second tube smoothly decreases from the second inner diameter to the channel minimum diameter.

4. The nozzle of claim 1, wherein in convergent section, the inner diameter of the second tube gradually and smoothly decreases from the second inner diameter to the channel minimum diameter.

5. The nozzle of claim 1, wherein the exit channel is approximately constant in diameter from channel minimum diameter to channel exit.

6. The nozzle of claim 1, wherein the exit channel is tapered such that the exit diameter is greater than the channel minimum diameter.

7. The nozzle of claim 1, wherein the first tube is tapered such that the first outer diameter is approximately equal to the first inner diameter at the first outlet orifice.

8. The nozzle of claim 1, wherein the first inner diameter and the channel minimum diameter are independently about 0.1 μm to 100 μm.

9. The nozzle of claim 1, wherein the first inner diameter and the channel minimum diameter are independently about 10 μm to 100 μm.

10. The nozzle of claim 1, wherein the channel length is about 1 to 100,000 times the channel minimum diameter.

11. The nozzle of claim 1, wherein the channel length is about 10 to 100 times the channel minimum diameter.

12. The nozzle of claim 1, wherein the channel minimum diameter is greater than or equal to the first inner diameter.

13. The nozzle of claim 1, wherein the channel minimum diameter is greater than the first inner diameter.

14. The nozzle of claim 1, further comprising an oscillator for introducing controlled acoustic oscillations into one or more fluids passing through the nozzle.

15. The nozzle of claim 1, further comprising a heater for heating the nozzle.

16. The nozzle of claim 1, further comprising a cooler for cooling the nozzle.

17. A method for producing a single-file stream of droplets comprising the steps of providing a nozzle according to claim 1; and injecting a first fluid through the first inlet orifice and a second fluid through the second inlet orifice, wherein the first and second fluids are both forced through the exit channel to produce a stream of the first fluid having a stream diameter less than the first inner diameter;

the stream breaks up within the exit channel or downstream of the exit channel to produce a single-file stream of droplets; and the exit orifice outputs the fluid stream or the single-file stream of droplets.

18. The method of claim 17, wherein the first fluid comprises a liquid and the second fluid comprises a gas.

19. The method of claim 18, wherein the second fluid, comprises one or more inert gases.

20. The method of claim 19, wherein the second fluid comprises hydrogen, nitrogen, carbon dioxide, helium, neon, argon, krypton, xenon, volatile hydrocarbon gases, or mixtures thereof.

21. The method of claim 18, wherein the first fluid further comprises an analyte.

22. The method of claim 21, wherein the analyte is a protein, protein complex, peptide, nucleic acid, lipid, functionalized nanoparticle, virus, bacteria, and cell or mixture thereof.

23. The method of claim 21, wherein the first fluid comprises a heterogeneous or homogeneous solution, or particulate suspension of the analyte in the first, fluid.

24. The method of claim 17, wherein the droplets have a diameter of less than 20 μm.

25. The method of claim 24, wherein the droplets have a diameter of less than 10 μm.

26. The method of claim 25, wherein the droplets have a diameter of less than 1 μm.

27. The method of claim 26, wherein the droplets have a diameter of less than 100 nm.

28. The method of claim 17, wherein the fluid flow within the exit channel is laminar.

29. The method of claim 17, wherein the first fluid is supplied to the first tube by a syringe pump.

30. The method of claim 17, wherein the second fluid is a gas and is supplied to the second tube at pressures ranging from 2 to 100 times atmospheric pressure.

31. The method of claim 30, wherein the first fluid is supplied to the first tube at pressures ranging from 2 to 35 times atmospheric pressure.

32. The method of claim 17, wherein the nozzle further comprises an oscillator, and the oscillator is operated at about 10-1000 kHz.

33. An injector comprising (i) a chamber comprising a vacuum orifice and an injector orifice, wherein the chamber is adapted for use with a high-vacuum analysis system; and (ii) a nozzle according claim 1, wherein the exit orifice of the nozzle outputs to the chamber and is essentially aligned with the injector orifice.

34. The injector of claim 33, wherein the first vacuum is maintained less than or equal to the high-vacuum system.

35. The injector of claim 33, wherein the injector orifice comprises a simple aperture.

36. The injector of claim 33, wherein the injector orifice comprises a tube.

37. The injector of claim 33, wherein the injector orifice further comprises molecular beam skimmer.

38. The injector of claim 33, further comprising an aligner for aligning the exit orifice of the nozzle with the injector orifice.

* * * * *